US006074167A

United States Patent [19]

Olifirov et al.

[11] Patent Number: 6,074,167

[45] Date of Patent: Jun. 13, 2000

[54] VARIABLE GEOMETRY CENTRIFUGAL PUMP

[75] Inventors: Fyodor N. Olifirov; Vladimir I. Petrov; Alexander A. Mikhailov, all of Moscow, Russian Federation

[73] Assignee: Woodward Governor Company, Rockford, Ill.

[21] Appl. No.: 09/244,785

[22] Filed: Feb. 5, 1999

[51] Int. Cl.[7] ..... F01D 17/14

[52] U.S. Cl. ..... 415/131; 415/157; 415/158

[58] Field of Search ..... 415/131, 132, 415/140, 150, 157, 158, 149.1

[56] References Cited

U.S. PATENT DOCUMENTS

| | | | |
|---|---|---|---|
| 2,927,536 | 3/1960 | Rhoades | 103/97 |
| 2,957,428 | 10/1960 | Meyer et al. | 103/126 |
| 3,482,523 | 12/1969 | Morando | 103/97 |
| 3,806,278 | 4/1974 | Grennan | 416/149 |
| 3,901,623 | 8/1975 | Grennan | 415/141 |
| 3,918,831 | 11/1975 | Grennan | 415/131 |
| 4,070,132 | 1/1978 | Lynch | 748/48 |
| 4,417,849 | 11/1983 | Morris | 415/131 |
| 4,828,454 | 5/1989 | Morris et al. | 415/48 |
| 4,832,565 | 5/1989 | Dussourd | 415/110 |

*Primary Examiner*—Edward K. Look
*Assistant Examiner*—Matthew T. Shanley
*Attorney, Agent, or Firm*—Leydig, Voit & Mayer Ltd

[57] ABSTRACT

A variable geometry centrifugal pump varies the pump output and/or centrifugal pump force by varying the effective radial length of the impeller vanes impelling fluid. The pump provides an impeller having graduated vanes with a shorter vane section for low output and a longer vane section for high output. A shroud carried in the impeller has female openings for the vanes to extend through to cover shorter or longer sections of the vanes. The shroud includes apertures for the axial pump inlet to extend through, thereby permitting the impeller to impel fluid on either side of the shroud.

20 Claims, 6 Drawing Sheets

VARIABLE GEOMETRY CENTRIFUGAL PUMP

FIELD OF THE INVENTION

The present invention generally relates to centrifugal pumps and more particularly to variable geometry centrifugal pumps.

BACKGROUND OF THE INVENTION

Centrifugal pumps typically comprise an impeller rotatably mounted in a pump body for impelling fluid radially outward from an inlet to an outlet. The impeller is typically connected to a rotating shaft and journalled within pump body bearings to rotate within the pump body. The impeller carries a plurality of radially extending vanes which engage fluid during rotation to centrifugally force fluid radially outward.

Many well known advantages and uses exist for centrifugal pumps. However, it is also well known that centrifugal pumps have had problems with heat production and pump efficiency when input or output parameters are varied. An example of one such problem occurs when the impeller is rotating at a given or fixed input speed to provide for high output flow when only a low output flow is desired. Under such conditions, the pump creates excess centrifugal force not needed for low output flow. The excess centrifugal force has typically caused an undesirable increase in pressure head, viscous losses and counterflow losses. The end result has been an undesirable increase in the fluid temperature and an overall decrease in pump efficiency.

Various approaches aimed at reducing the problems associated with centrifugal pumps are disclosed in several U.S. patents. One prior approach varies the geometry of the vanes carried by the impeller. The pumps of this approach are commonly referred to as variable geometry centrifugal pumps, also sometimes referred to as variable performance, variable flow or variable capacity centrifugal pumps. U.S. Pat. Nos. 4,828,454 to Morris, 4,070,132 to Lynch, 3,482,523 to Morando, 2,927,536 to Rhoades and 2,957,424 to Brundage disclose various forms of a variable geometry pump. As generally disclosed in the aforementioned patents, the typical approach to provide a variable geometry centrifugal pump has been to axially translate a shroud to and from the impeller to vary the axial width the vanes and the flow channels between adjacent vanes. The shroud is typically plate shaped and provides female grooves or slots for receiving the vanes. The shroud may be actively translated about the vanes during pumping operation by various fluid, electrical or mechanical actuators and other forms of actuating devices. Some of the various actuating mechanisms are disclosed in these aforementioned patents.

Grennan, U.S. Pat. No. 3,806,278 also shows a similar approach to the aforementioned variable geometry centrifugal pumps but on a different type of pump impeller for a different type of pump. In Grennan '278, a single vane extends axially in a spiral fashion around a central shaft in auger-like or screw like fashion. To vary the width of the spiral flow channel defined by the vane. Grennan '278 discloses a threaded hub type shroud with a spiral female slot for receiving the vane. The hub screws on to the vane to fill in portions of the flow channel near the shaft and decrease the inner diameter of the vane.

Despite any improvements provided by these attempts at variable geometry centrifugal pumps, these pumps have had several drawbacks. One drawback is that of limited design flexibility. Past approaches typically have relied on reducing the axial width of the vanes and associated flow channels. Such approaches are limited in that the flow channels still must be wide enough to efficiently transmit fluid from the inlet to the outlet. Flow channels which are too narrow have problems such as reduced pump efficiency through increased drag. Another drawback in many previous approaches is that the movable shroud can cause increased pump wear or leakage between the outlet and inlet as the shroud axially translates and rotates in relation to the pump body. Yet another drawback existing with these past attempts is their inability stabilize or control pressure head, maintain pump efficiency, and prevent heat production in a prudent or satisfactory manner for many desired applications.

SUMMARY OF THE INVENTION

In view of the foregoing, it is a general aim of the present invention to overcome the problems associated with centrifugal pumps having variable output or input conditions.

Another general aim of the present invention is to provide for greater flexibility in the design of variable geometry centrifugal pumps.

It is an object of the present invention to provide an improved approach for varying the centrifugal force applied by a centrifugal pump.

Another object of the present invention is to provide a centrifugal pump having higher pumping efficiency over a desired range of pump outputs.

Another object of the present invention is to provide a centrifugal pump that provides better control of pressure head over a desired range of speeds and flow rates.

Another object of the present invention is to provide a centrifugal pump having lower heat production over a desired range of pump outputs.

In accordance with these aims and other and objects, the present invention provides a centrifugal pump in which the radially extending length or the outer radius of the vanes are adapted to be longer or shorter depending upon a desired flow rate and/or a desired pressure head.

In the preferred embodiment, the outer radial boundary or length of the impeller vanes are of a graduated or compound configuration to achieve variable geometry. Preferably, the vanes carried by the impeller have a wider section near the inlet and a narrower section near the outlet. The wider section of the vanes near the inlet are for low output conditions while the narrower section of the vanes near the outlet are for higher output conditions. A shroud is movable about the vanes to selectively expose different portions of the vanes to control the length of the vanes. By changing the effective outer length or radius of the vanes, the centrifugal force applied by the pump is thereby controlled to better provide for the desired fluid input and output conditions, with high pump efficiency and low heat production.

Another related feature of the preferred embodiment is that the shroud is housed within a chamber of the impeller between plate and ring members of the impeller and includes openings slidably receiving the vanes therethrough. Axial translation of the shroud relative to the vanes permits the pump to impel fluid on either side of the shroud. Advantageously, the movable shroud does not come in close contact with the pump body which increases pump reliability. Another advantage of having the shroud movable about the vanes in this manner is that the overall width of the flow channels can be maintained when operating the shroud between high and low output positions. The shroud may also have intermediate positions to provide intermediate output flow conditions. In some of the intermediate positions, the vanes may impel fluid from the inlet to the outlet on one side of the shroud while fluid recirculates on the other side of the shroud without substantial sacrifice of pump efficiency.

These and other objects and advantages of the invention will become more apparent from the following detailed description when taken in conjunction with the accompanying drawings.

Figure 1A:
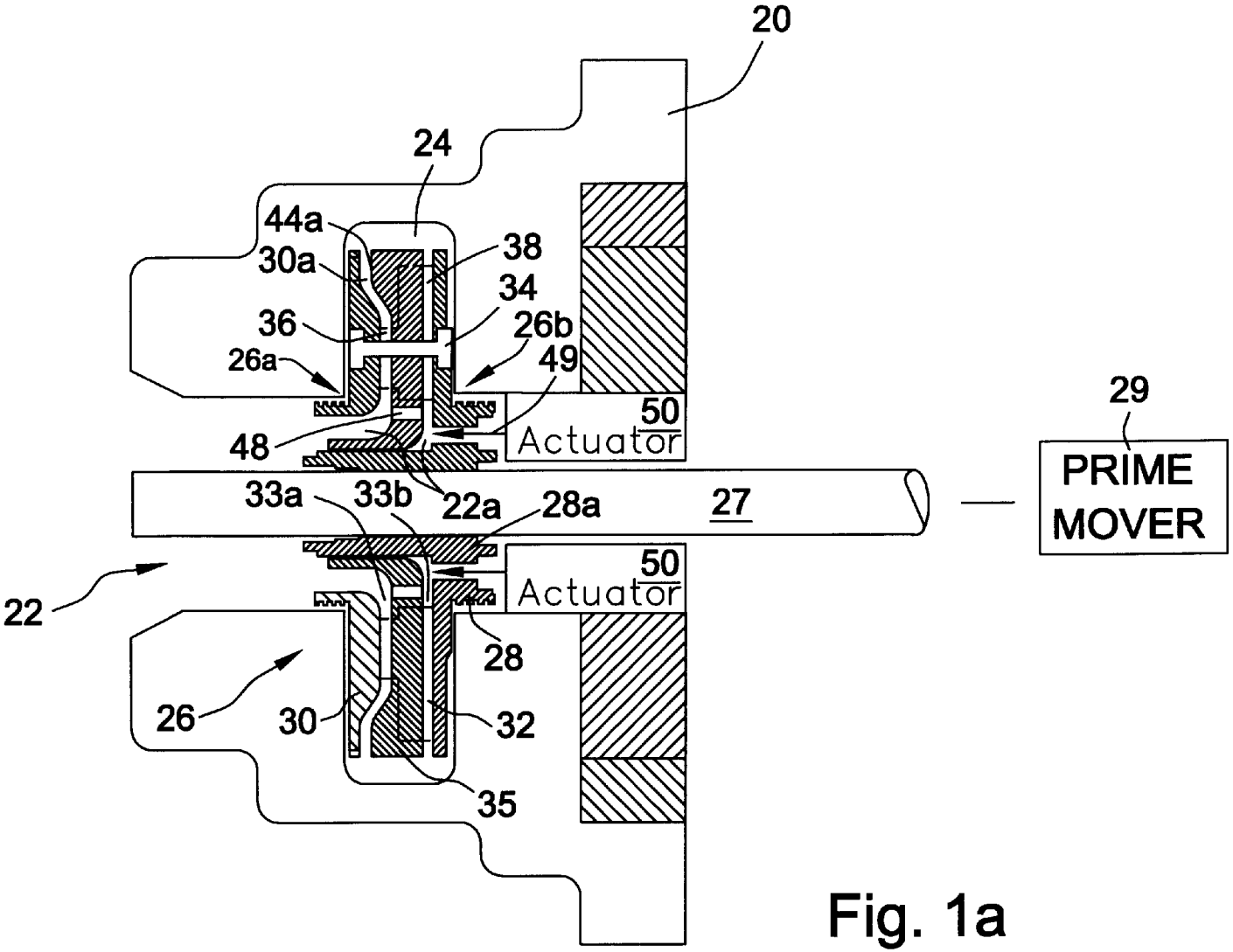
FIG. 1*a* is a cross-sectional view of a variable geometry centrifugal pump shown in partly schematic form at an intermediate output flow position in accordance with the preferred embodiment of the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Referring to FIG. 1*a,* a variable geometry pump in accordance with the preferred embodiment of the present invention comprises a pump body 20 having an axial fluid inlet 22 and a radial fluid outlet 24 with an impeller 26 mounted for rotation inside the pump body 20. The impeller 26 is coupled to a pump shaft 27 to receive rotary movement from a prime mover 29 and thereby impel fluid entering from the inlet 22 radially outward to the outlet 24. Pump shaft 28 is preferably journalled in case bearings (not shown) to prevent wear of the pump and to maintain rotational alignment of the impeller 26 inside the pump body 20.

Figure 4:
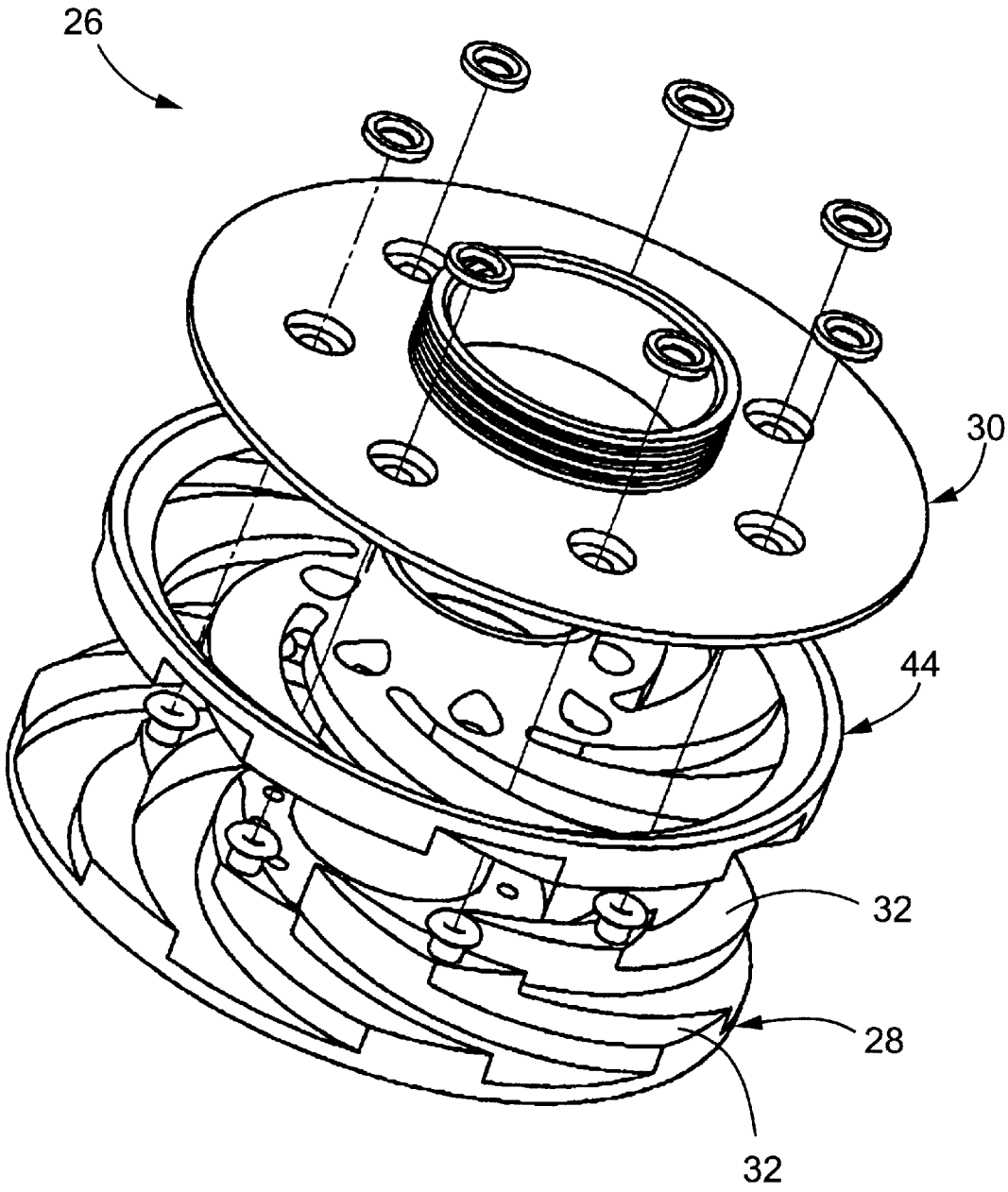
FIG. 4 is an exploded view of an impeller in accordance with the preferred embodiment of the present invention.

In the preferred embodiment of the present invention and referring to FIGS. 1*a* and 4, the impeller 26 includes an inner disc 28 or other suitable type of plate support member, and an outer ring 30 that has provides a central opening to accommodate inlet 22. The impeller 26 carries a plurality of radially extending vanes 32 for impelling fluid between the disc 28 and ring 30. In the preferred embodiment the inner disc 28 includes a center sleeve portion 28*a* secured over the shaft 27, however a solid plate member cantilevered to a shaft could also be used in an alternative embodiment. The vanes 32 preferably extend in a slight spiral fashion as they extend radially (See FIG. 2) and are preferably integrally connected the inner disc 28 to receive the rotation necessary to impel fluid from the inlet 22 to the outlet 24. The outer ring 30 is abutted against the vanes 32 and is fixed to the inner disk 28 by any suitable fastener or other means, shown as rivets 34 in FIG. 1*a.* By fixing the inner disc 28 and outer ring 30, the impeller 26 maintains an approximate seal within the pump body 20 as generally indicated at 26*a* and 26*b.* To supply fluid to the vanes 32, the inlet 22 has a hollow cavity portion 22*a* extending through the outer ring 30 and into the impeller 26.

Figure 1B:
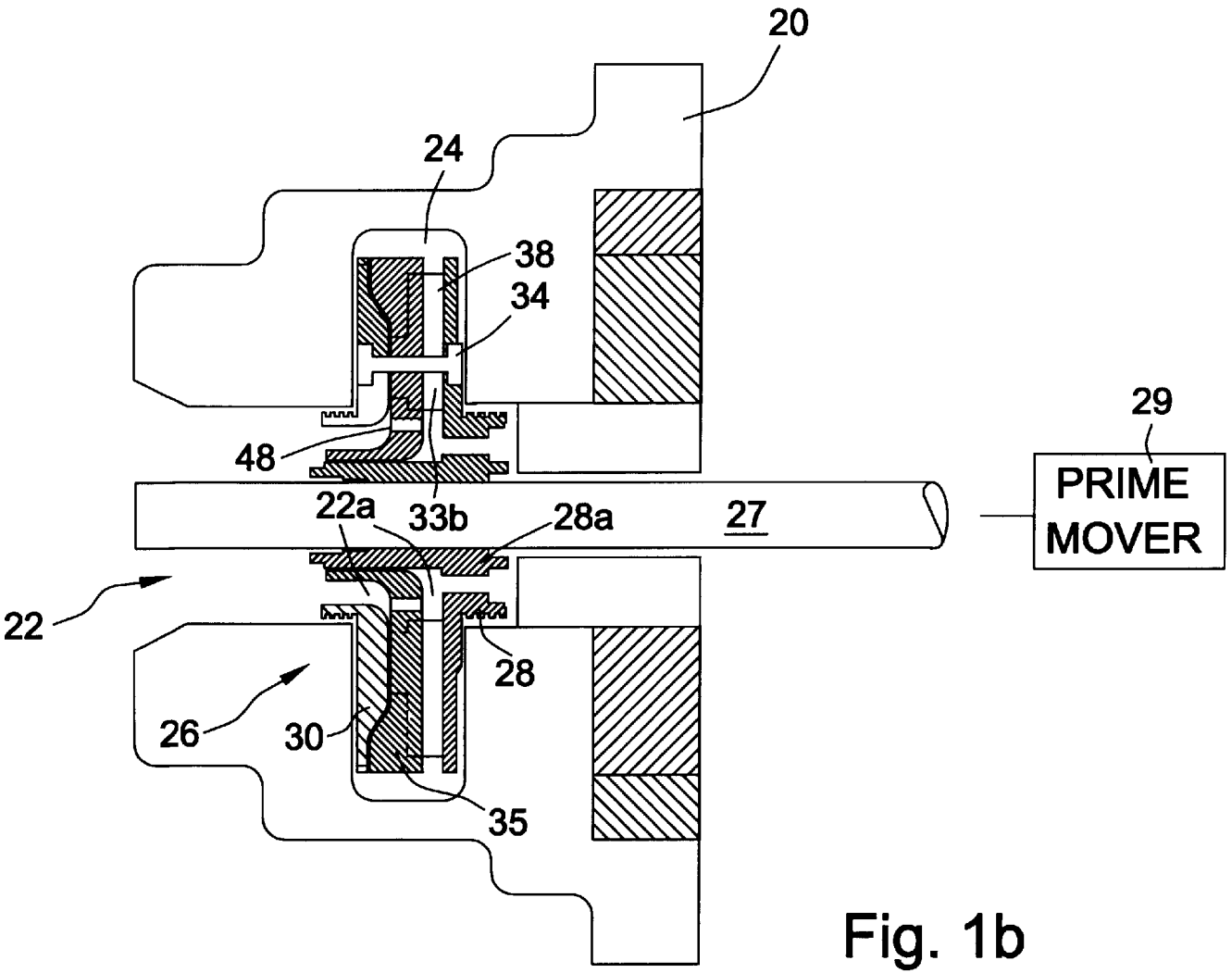
FIG. 1*b* is a cross-sectional view of the variable geometry centrifugal pump of FIG. 1*a* at a high output flow position.
Figure 1C:
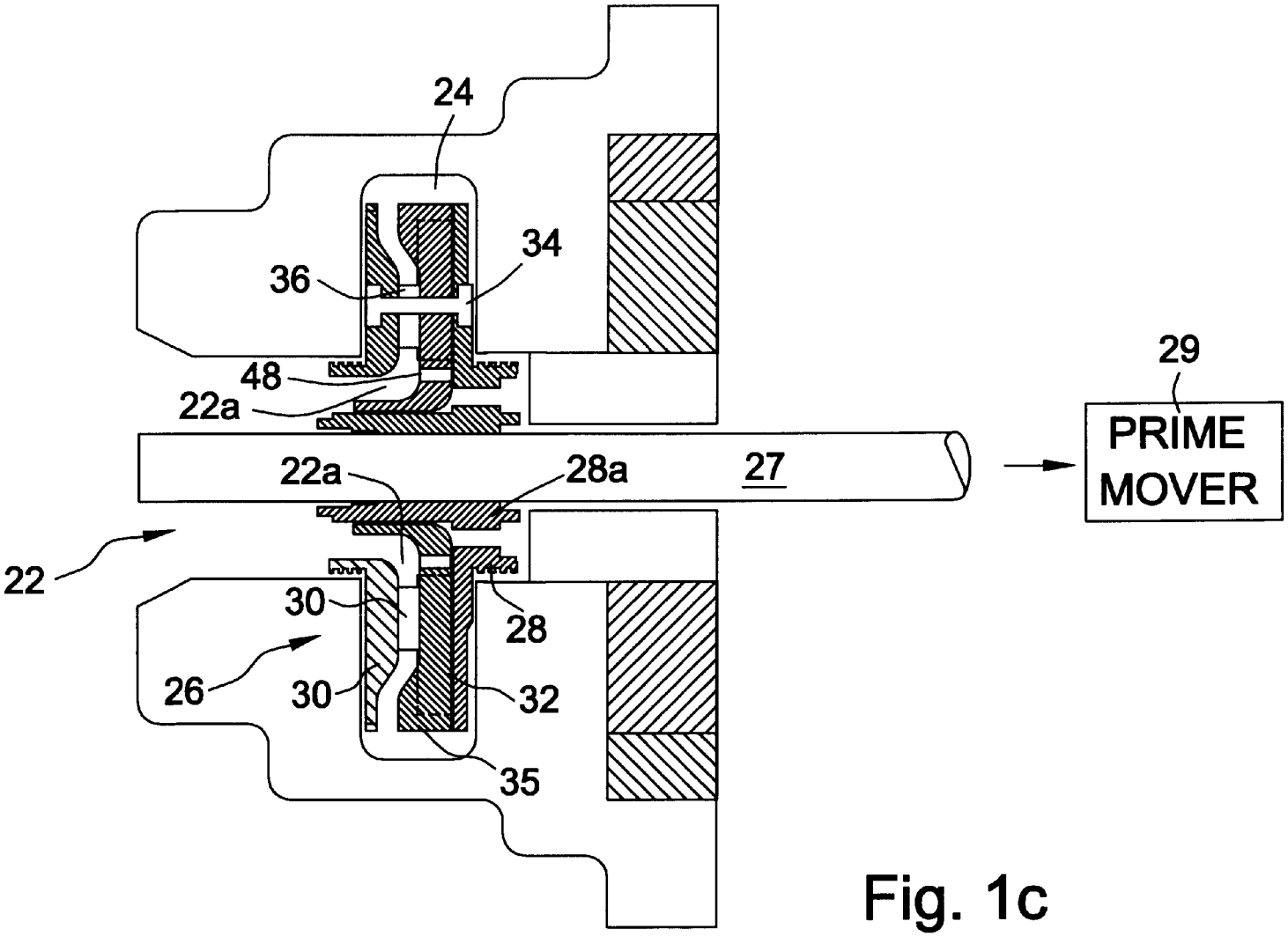
FIG. 1*c* is a cross-sectional view of the variable geometry centrifugal pump of FIG. 1*a* at a low output flow position.

In accordance with the aims, features and objects of the present invention, the preferred embodiment varies the exposed radial length of the vanes 32 to vary the output of the pump. To accomplish this, the preferred embodiment includes a shroud 35 which is axially translatable relative to the vanes 32 to expose longer or shorter sections of the vanes 32. This concept is illustrated by comparing the shroud position in FIGS. 1*a,* 1*b,* and 1*c* of the preferred embodiment. FIG. 1*c* shows the shroud 35 covering part of the vanes 32 and exposing a shorter length portion 36 for impelling fluid for decreased pump output. FIG. 1*b* shows the shroud 35 exposing a longer length portion 38 for impelling fluid at an increased pump output.

Figure 2:
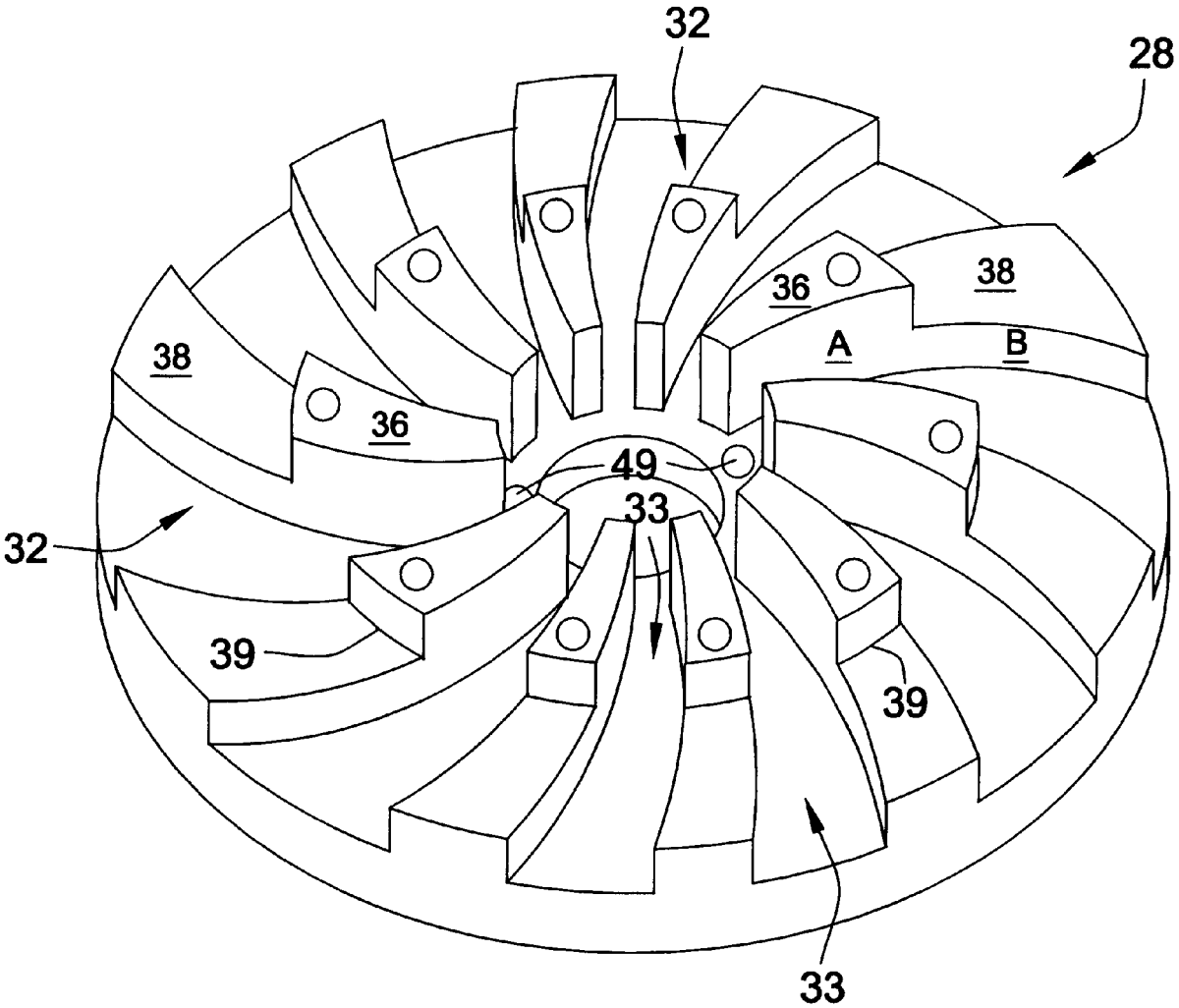
FIG. 2 is a perspective view of an exemplary impeller with stepped vane configuration in accordance with the preferred embodiment of the invention.

Variable vane length is provided for in the preferred embodiment by graduated or compound configuration in the vanes 32. Accordingly, it is seen that the vanes 32 generally are of stepped configuration as the vanes 32 radially extend in a spiral fashion, as best illustrated in FIG. 2. Each vane includes a longer length portion 38 to provide for higher output and a shorter portion 36 to provide for lower output. Put a different way and as illustrated in FIG. 2 and FIG. 1*a,* the vanes 32 generally include an axially wider section A nearer the inlet 22 and an axially narrower section B nearer the outlet 24. As best seen in FIG. 2 of the preferred embodiment, the longer length vane portion 38 has an maximum outer radius that is preferably about twice as long as minimum radius of the shorter vane portion 36. However compound configurations with different ratios of lengths between the longer and shorter portions are possible depending upon differences between desired maximum and minimum pump outputs for given pump input parameters. Although corner 39 provides a stepped vane outer boundary as shown in FIG. 2, it will be appreciated to those skilled in the art that other such compound configurations of vanes are also possible and within the scope of the invention, including but not limited to smooth steeply inclined boundaries or a multiple stepped boundaries, or any other suitable configuration which suggests itself. In operation, the vanes 32 engage fluid in flow channels 33 to impel fluid from the inlet to the outlet. As shown in FIG. 2 the flow channels 33 are located between adjacent vanes 32 and provide passageways for communicating fluid to the outlet 24.

It is apparent at this point that the approach of the present invention is an improved approach for varying the centrifugal force of the pump by varying the outer radial length of the vanes. In the preferred embodiment of the present invention, the length of the vanes affects centrifugal force in at least two distinct ways. First, because radially outer portions of vanes move faster than radially inner portions of the vanes at any given rotational speed, the average speed of the vanes impelling fluid changes with vane length. Second, because area is a function of length, the surface area of the vanes impelling fluid changes with vane length. By controlling the length of the vanes, variable geometry pumps operate in a more satisfactory manner. By varying length of the vanes, the preferred embodiment also provides for a wide range of desired outputs without substantial loss in pump efficiency or substantial heat production.

Figure 3B:
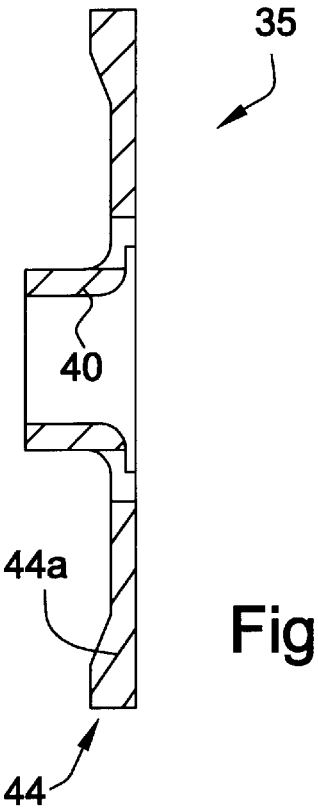
FIG. 3*b* is a cross sectional view of the movable shroud of FIG. 3*a*.
Figure 3A:
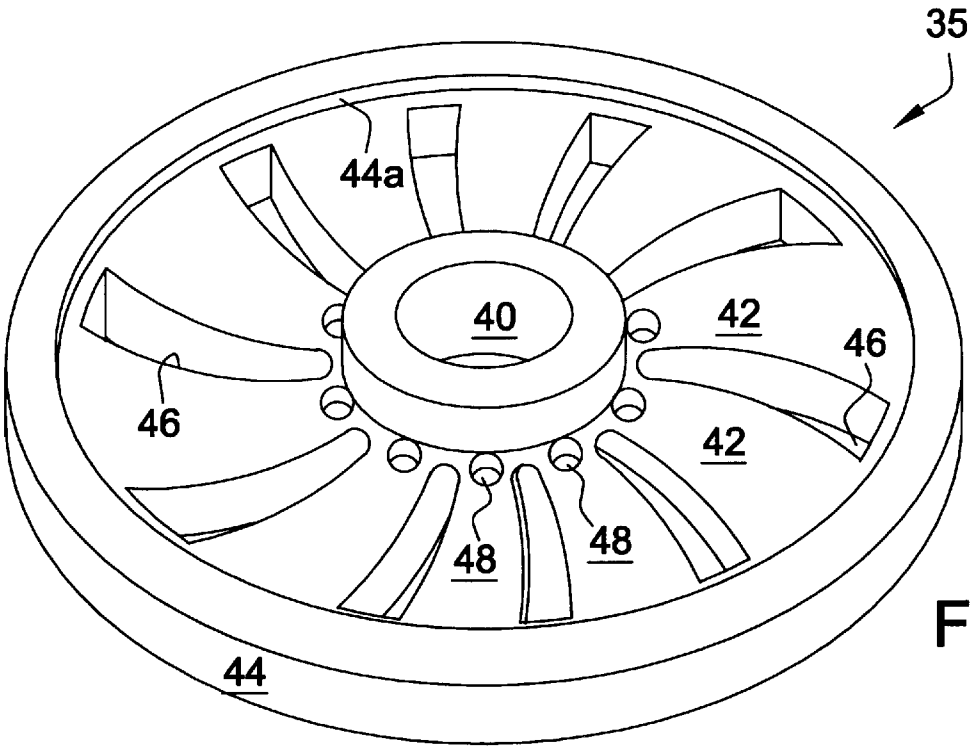
FIG. 3*a* is a perspective view an exemplary movable shroud for covering and exposing different sections of vanes on an impeller in accordance with the preferred embodiment of the invention.

With the basic understanding of some of the inventive features of the preferred embodiment as described above, attention will now be directed in more detail to the shroud 35, an exemplary embodiment of which is shown in FIG. 3*a* and 3*b*. With reference first to FIG. 1*a*, it is seen that the shroud 35 is housed inside the impeller 26 between the outer ring 30 and the inner disc 28. The shroud 35 is axially translatable within the impeller 26 to selectively expose different portions of the vanes 32. As best structurally shown in FIG. 3*a*, the shroud 35 has an inner hub 40 for encircling sleeve 28*a* of the impeller 26. The inner hub 40 is connected by spiral ribs 42 to a rim 44. The rim 44 has a segment 44*a* accommodated by a recessed portion 30*a* (See FIG. 1*a*) in the outer ring 30 that makes the rim 44 thicker than the ribs 42. In the preferred embodiment, the rim 44 is thicker to provide for better balance of the shroud 35 within the impeller 26 during rotation. The vanes 32 extend through and fill spiral receiving openings 46 located between adjacent spiral ribs 42. Because the vanes 32 and the shroud 35 have a close interfitting relationship, the shroud 35 variably exposes different portions of the vanes 32 and variably fills in portions of the flow channels 33 as illustrated by FIGS. 1*a*, 1*b*, and 1*c*. By axially translating the shroud 35 over the vanes 32, the centrifugal pump provides for changes in the fluid output of the pump.

In accordance with one of the features of the present invention and with reference again to FIG. 1*a*, the shroud 35 also divides the flow channels 33 to vary the output performance of the pump. As illustrated by FIGS. 1*a*–1*c*, fluid is capable of being impelled on either side of the shroud 35. The shroud 35 divides the flow channels 33 into separate and variably sized flow passages 33*a*, 33*b* including first flow passages 33*a* between the shroud 35 and the outer ring 30 and second flow passages 33*b* between the shroud 35 and the inner disc 28. A plurality of apertures 48 located in the hub 40 of the shroud 35 extends the inlet 22 through the shroud as it translates. The apertures 48 provide for fluid flow through the shroud 35 to supply fluid to the second flow passages 33*b*. In the present embodiment as shown best in FIG. 1*a*, the apertures 48 are aligned with the second flow passages 33*b* and are sized large enough so as not to restrict flow through the shroud 35.

In the present embodiment depicted in FIG. 1*a*, the longer vane portion receives fluid through the apertures 48. It will be understood that the location of the longer or shorter vanes can be on either side of the shroud with respect to the inlet. It will also be understood that other means could extend the inlet to both sides of the shroud, for example, inner portions of the shroud hub could be removed instead of providing apertures.

Numerous operating positions are possible for the shroud 35 in the preferred embodiment of the invention. As shown in FIG. 1*b*, the pump has been set to operate at a high output position. At the high output position the shroud 35 has an axial position adjacent to the outer ring 30. In this position, the shroud 35 exposes the longer length portion 38 of the vanes 32 which increases centrifugal force and thus fluid output of the pump. In this position, fluid flows through the apertures 48 and is impelled by the longer length portion 38 of the vanes 32. The shroud 35 covers the shorter length portion 36 of the vanes 32 or part of the wider section A (See FIG. 2) near the inlet 22. In the high output position, flow through the first flow passage 33*a* has been substantially cut off as fluid primarily flows through the second flow passage 33*b*.

FIG. 1*c* shows the preferred embodiment of the present invention for operating at a low output. Here, the shroud 35 has been axially translated from the high output position as in FIGS. 1*b* to a position adjacent to the inner disc 28. In this low output position, the shroud 35 is covering all or substantially all of the longer length portion 38 of the vanes 32 to reduce centrifugal force and reduce output of the pump. In the low output position, the shroud 35 substantially fills in the second flow passage 46 and exposes the shorter length portion 36 or wider section A (See FIG. 2) of the vanes 32. Fluid is then impelled by the shorter length portion 36 of the vanes through the first flow passage 33*a*.

In the preferred embodiment of the present invention, the effective width of the flow channels 33 are about the same for the low output position and the high output position. However, as the shroud 35 translates from high output to low output, the mean outer radial length of the vanes 32 has decreased and the exposed surface area of the vanes 32 has decreased as well. Both of these factors contribute to decreasing the output of the pump. The particular described embodiments of the present invention is particularly beneficial when a pump application primarily needs only two different pump outputs. The length of the vanes can be precisely controlled to provide two primary different pump outputs.

The preferred embodiment of the present invention can also provide multiple intermediate positions in which the shroud 35 is positioned between the full flow and the low flow positions in which both fluid passages are open and permitting communication of fluid. Although other intermediate positions exists, the particular intermediate position as shown in FIG. 1*a* will be discussed. At this intermediate position and under certain input and output conditions, the vanes 32 impel fluid in through the second flow passage 33*b* while recirculating fluid from the outlet 24 to the inlet 22 between the shroud 35 and the inner disc 28 through the first flow passage 33*a* past part of the shorter length vane portions. In general, the intermediate positions provide for various intermediate outputs between the high output and low output when more than two operating positions are desired. Importantly, the intermediate positions maintain high pump efficiency and low temperature in the fluid by varying the effective length and area of the vanes 32 impelling fluid.

In the embodiments depicted in FIGS. 1*a*–1*c*, variable pump output is provided by axially translating the shroud relative to the vanes. To achieve axial translation in the preferred embodiment and referring now to FIGS. 1*a* and 2, it is also seen that the inner disc 28 includes holes 49. The holes provide means for receiving a mechanism or device for actuating or setting a position of the shroud 35 inside the impeller 26. FIG. 1*a* shows schematically an actuator 50 extending through the holes 49 to engage the shroud 35 and thereby adapt the pump for lower or higher output. Although holes 49 and schematic actuator 50 are shown, it will be appreciated that any means which achieves axial translation between the vanes and the shroud is within the scope of the invention and is hereby also included. For example, in the simplest form, shroud position could be adjusted by positioning screw assemblies threadingly received in holes 49 or other manually positionable means when the pump is idle. In more complex forms, bearing or other transfer assemblies along with mechanical, pneumatic, hydraulic, or electrical actuators could control shroud position through holes 49. Other similar actuating mechanism will be readily apparent to those skilled in the art.

What is claimed is:

1. A variable geometry centrifugal pump comprising:

a pump body having an axial fluid inlet and a radial fluid outlet;

an impeller mounted for rotation in the pump body and carrying a plurality of vanes adapted to impel fluid from the inlet to the outlet, the vanes being of compound configuration having a longer section for creating high output flow and a shorter section for creating lower output flow; and a movable shroud associated with the impeller and slidable over the vanes to selectively expose the longer or shorter sections of the vanes, thereby to control the pressure and flow through the pump.

2. The variable geometry pump of claim 1 in which the shroud extends into the pump inlet, the shroud providing an aperture for accommodating fluid flow through the shroud.

3. The variable geometry pump of claim 2 in which the shroud has a low output position in which fluid is impelled by the shorter section of the vanes from the inlet to the outlet.

4. The variable geometry pump of claim 3 wherein the shroud has a high output position in which the shroud is positioned so that fluid flow is from the inlet through the aperture in the shroud, the longer section of the vanes impelling fluid from the inlet to the outlet.

5. The variable geometry pump of claim 4 wherein the shroud has an intermediate position in which a portion of the longer section of the vanes produces high output flow at the outlet, and the shroud allows a recirculating flow from the outlet to the inlet past part of the shorter section of the vanes.

6. A variable geometry centrifugal pump comprising:

a pump body having an axial fluid inlet and a radial fluid outlet;

an impeller mounted for rotation in the pump body carrying a plurality of vanes extending radially outward from the inlet to the outlet, the vanes extending axially with a wider axial section near the inlet and a thinner axial section near the outlet; and a shroud associated with the impeller and defining slots for receiving the vanes, the shroud adapted to selectively cover substantially all of the thinner surface section while exposing the wider section to thereby reduce centrifugal force applied to fluid during pumping operation.

7. The variable geometry centrifugal pump as in claim 6 wherein the slots comprise openings with the vanes extending through the openings, the shroud being movable about the vanes to selectively expose the wider section on one side of the shroud and the narrower thinner section on the other side of the shroud.

8. The variable geometry centrifugal pump as in claim 7 wherein the shroud has an intermediate output position relative to the impeller for exposing part of the wider section and part of the thinner section, the pump being operable to pump fluid from the inlet to the outlet along the vanes in the thinner section and simultaneously circulate fluid from the outlet to the inlet along the wider section.

9. A variable geometry centrifugal pump as in claim 7 wherein the shroud further defines a plurality of apertures extending the inlet past the shroud.

10. A variable geometry centrifugal pump as in claim 6 wherein the pump has a high output position wherein the shroud is adapted to expose the thinner surface section while exposing the wider section to thereby increase the centrifugal force applied to fluid.

11. A variable geometry centrifugal pump as in claim 6 wherein the shroud is adapted to axially translate while the vanes are axially fixed relative to the pump body.

12. A variable geometry centrifugal pump comprising:

a pump body having an axial fluid inlet and a radial fluid outlet;

an impeller mounted for rotation within the pump body, the impeller including a ring member and a plate member;

a plurality of vanes disposed between the ring and plate members, the vanes extending radially outward from the inlet to the outlet, the vanes having a radially inward portion near the inlet a radially outward portion near the outlet; and a shroud interposed between the ring and plate members and having a plurality of openings slidably receiving the vanes therethrough, the shroud having a low output position covering substantially all of the outer portion while exposing the inward portion and a high output position exposing the outward portion.

13. The variable geometry pump as in claim 12 wherein the vanes have a graduated outer radial length between the plate and ring members.

14. The variable geometry pump as in claim 12 wherein the impeller defines a plurality of flow channels between adjacent vanes, the shroud movable about the vanes to divide the channels into two sets of flow passages, one on each side of the shroud.

15. The variable geometry pump as in claim 14 wherein the shroud defines a plurality of apertures aligned with the flow passages to accommodate fluid flow through the shroud.

16. The variable geometry pump as in claim 14, wherein the shroud has an intermediate output position in which the vanes impel fluid on a first side of the shroud with fluid recirculating from the outlet to the inlet on a second side of the shroud.

17. The variable geometry pump as in claim 12 wherein the shroud has a high output position in which the outer portion is exposed by the shroud.

18. A variable capacity centrifugal pump comprising:

a pump body having an axial fluid inlet and a radial fluid outlet;

an impeller mounted for rotation inside the pump body including a ring member and a plate member;

a plurality of vanes carried by the impeller between the first and second plate members, the vanes extending radially from the inlet to the outlet; and a shroud interposed between the ring and plate members and having a plurality of openings slidably receiving the vanes therethrough, the shroud dividing the impeller into first and second sets of flow passages, one set of flow passages on each side of the shroud between adjacent vanes, the inlet extending past the shroud to feed fluid to both the first and second flow passages, axial translation between the shroud and the vanes variably adjusting the width of the flow passages to control the output of the pump.

19. The variable capacity centrifugal pump as in claim 18 wherein the shroud includes a plurality of apertures for communicating fluid through the shroud, thereby extending the inlet through the shroud.

20. The variable capacity centrifugal pump as in claim 18 wherein the outer radial length of the vanes is graduated to include longer and shorter length sections as the vanes extend axially between the plate and the ring, the shroud adapted to selectively expose shorter and longer sections of the vanes to thereby control the flow and pressure through the pump.

* * * * *